United States Patent [19]

Watson

[11] 4,219,299

[45] Aug. 26, 1980

[54] APPARATUS FOR UNWRAPPING BREAD

[76] Inventor: James C. Watson, Six Crestview Ave., Westboro, Mass. 01581

[21] Appl. No.: 930,316

[22] Filed: Aug. 2, 1978

[51] Int. Cl.[2] ..... B65G 65/04

[52] U.S. Cl. ..... 414/412; 83/175; 83/435.2; 198/626

[58] Field of Search ..... 414/412; 198/626–628; 53/384, 386; 83/18, 175, 435, 435.2, 437; 30/2

[56] References Cited

U.S. PATENT DOCUMENTS

| | | | |
|---|---|---|---|
| 2,205,338 | 6/1940 | Beutel | 198/626 X |
| 2,484,780 | 10/1949 | Clunan et al. | 198/626 X |
| 2,729,885 | 1/1956 | Wahl | 30/2 |
| 2,753,907 | 7/1956 | Schmidt | 83/435.2 X |
| 3,333,496 | 8/1967 | Fox | 83/435 X |
| 3,757,973 | 9/1973 | Lambert | 414/412 |
| 3,811,586 | 5/1974 | Lavoie | 414/412 |
| 3,863,790 | 2/1975 | Kanarek | 414/412 |
| 3,889,442 | 6/1975 | Grahn | 414/412 X |
| 3,922,778 | 12/1975 | Aalpoel | 30/2 |
| 4,034,877 | 7/1977 | Bennison | 414/412 |
| 4,036,380 | 7/1977 | Berry et al. | 414/412 |

FOREIGN PATENT DOCUMENTS

| | | | |
|---|---|---|---|
| 1040458 | 10/1958 | Fed. Rep. of Germany | 414/412 |
| 2218026 | 11/1973 | Fed. Rep. of Germany | 414/412 |

*Primary Examiner*—Robert G. Sheridan
*Assistant Examiner*—Terrance L. Siemens
*Attorney, Agent, or Firm*—Norman S. Blodgett; Gerry A. Blodgett

[57] ABSTRACT

Unwrapping bread by vertically compressing a wrapped loaf to produce excess wrapping material at the sides thereof, clamping the excess wrapper material and stretching the wrapper at the bottom of the loaf, separating the cut wrapper from the bread while retaining the excess wrapper material, and thereafter releasing the wrapper.

15 Claims, 11 Drawing Figures

APPARATUS FOR UNWRAPPING BREAD

BACKGROUND OF THE INVENTION

The invention relates generally to recycling of stale bread that has been returned to a bakery. In the baking industry, stale bread is made into crumbs or croutons, and then sold in packages as a bread supplement to foods. In the past, the removal of the wrapper from the stale bread has been a hand operation involving considerable time and labor.

Automatic machinery has been developed in the packaging industry for opening bags of free flowing or particulate material, or for the opening of cartons. There are no known machines for removing the wrapper from loaves of bread. The existing machines for opening bags of free flowing or particulate material are totally unsuited for opening loaves of bread and removing the bread from their wrappers. Wrapped loaves of bread have special characteristics which make it extremely difficult for handling and unwrapping. A wrapped loaf of bread is light, soft, and the wrapping material is generally clingy, making it difficult to be completely separated from the bread. These and other difficulties associated with the removal of bread wrappers from loaves of bread have been obviated by the present invention.

It is, therefore, an outstanding object of the invention to provide a method of separating the wrapper and bread from a wrapped loaf of bread which greatly facilitates the process.

Another object of the invention is the provision of a method of unwrapping bread which enables automatic machinery to be used to carry out the process.

A further object of the present invention is the provision of automatic machinery for carrying out the method of the present invention.

It is another object of the instant invention to provide automatic bread unwrapping machinery which conveys wrapped loaves of bread, separates the wrappers from the loaves and conveys the wrappers and bread separately to separate disposal points.

A still further object of the present invention is the provision of automatic unwrapping machinery which will handle sealed loaves of bread, as well as wrapped loaves of bread in which the seal has been broken.

It is a further object of the invention to provide automatic machinery for unwrapping bread which is simple in construction, which is inexpensive to manufacture, which is mechanically reliable, and which is capable of a long life of useful service with a minimum of maintenance.

It is a further object of the invention to provide automatic bread unwrapping machinery in which the wrapper is under positive control throughout the process of separating the wrapper from the bread.

It is a further object of the invention to provide automatic bread unwrapping machinery in which the wrapper is maintained under positive control after separation of the wrapper and bread until final disposition of the wrapper.

With these and other objects in view, as will be apparent to those skilled in the art, the invention resides in the combination of parts set forth in the specification and covered by the claims appended hereto.

SUMMARY OF THE INVENTION

In general, the invention consists of a method and apparatus for removing the wrapper from a wrapped loaf of bread in which a conveyed wrapped loaf of bread is vertically compressed, so that an excess of wrapper material is formed at each side of the loaf. This excess wrapper material on each side of the loaf is clamped and stretched laterally of the loaf, thereby making the bottom and top sections of the wrapper taut. The tightly-stretched wrapper is cut along the bottom of the loaf and the bread and wrapper are separated. Specifically, the removed wrapper is retained and conveyed to a disposal means and the removed bread is conveyed to processing machinery where it is made into crumbs and packaged for cooking purposes.

More specifically, the machinery consists of upper and lower conveyors for compressing the bread and creating a bulge of excess wrapper material at the side of the loaf. The excess wrapper material at each side of the loaf is clamped between a V-belt and pulley wheel. The wheels diverge to stretch the wrapper and pull the top and bottom portions taut, whereupon a knife slits the bottom expanse of the bread wrapper. After the wrapper has been cut, relative motion between the clamping elements and upper conveyor causes the wrapper to be pulled away from the bread. The clamping elements convey the wrapper to a disposal point and a take-away conveyor removes the bread from a separation area and conveys it toward bread processing machinery. The unwrapping machinery also includes cam plates for guiding the excess wrapper material toward the clamping elements and suction means for holding the excess wrapper material outwardly from the loaf to insure clamping by the clamping elements.

BREIF DESCRIPTION OF THE DRAWINGS

The character of the invention, however, may be best understood by reference to one of its structural forms, as illustrated by the accompanying drawings in which:

FIG. 1 is a front elevational view of a bread unwrapping machine embodying the principles of the present invention, FIG. 2 is a side elevational view of the bread unwrapping machine, looking in the direction of arrow II in FIG. 1, FIG. 3 is an enlarged fragmentary view of a portion of FIG. 2 in the area where clamping and cutting of the wrapper takes place, FIG. 4 is a diagrammatic side view of the drive means for the various machine components, looking in the direction of arrow IV of FIG. 1, and FIGS. 5–11 are schematic views showing the various steps in removing the wrapper from the loaf of bread, the steps shown in FIGS. 5–11 occurring along lines V–XI, respectively, as viewed in FIG. 2 and looking upstream of the machine.

DESCRIPTION OF THE PREFERRED EMBODIMENT

Figure 5:
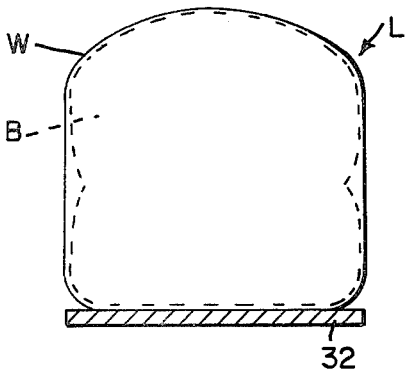
Figure 9:
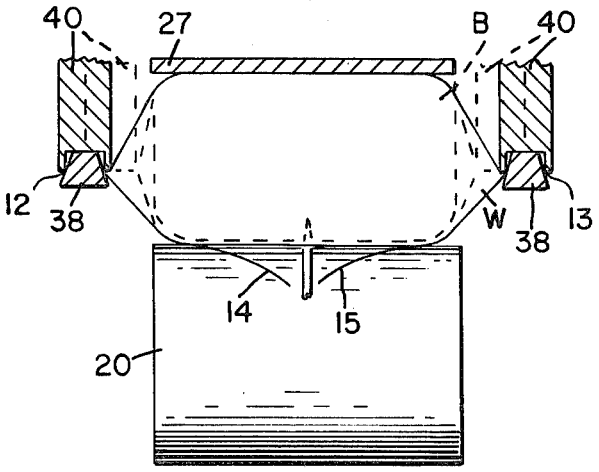
Figure 6:
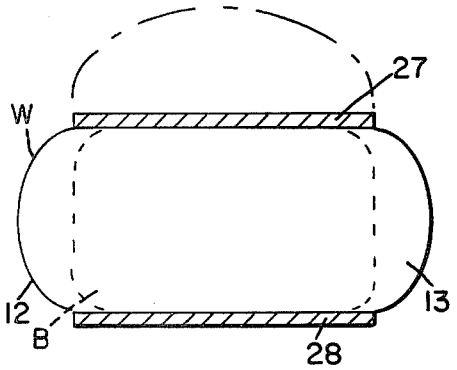
Figure 10:
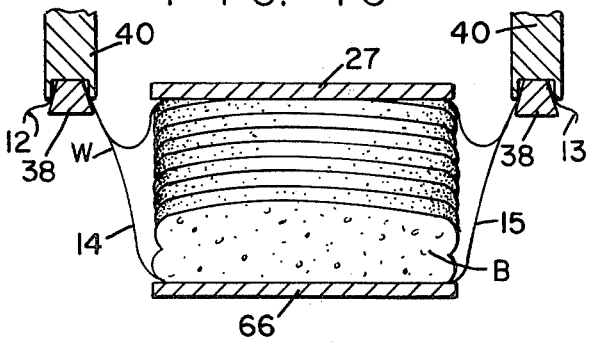
Figure 7:
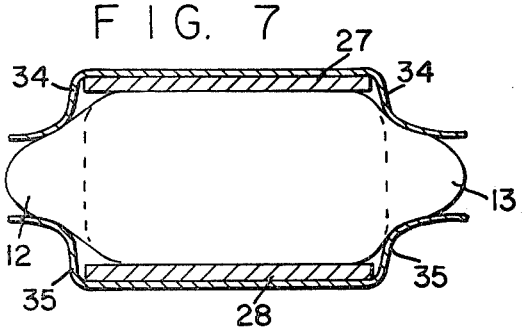
Figure 11:
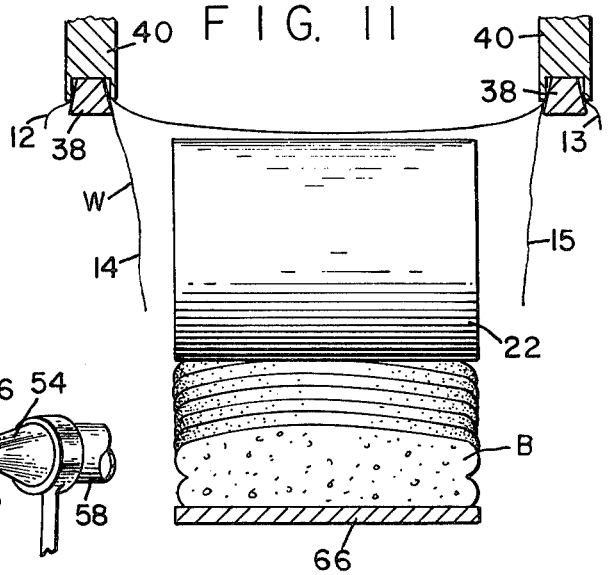
Figure 8:
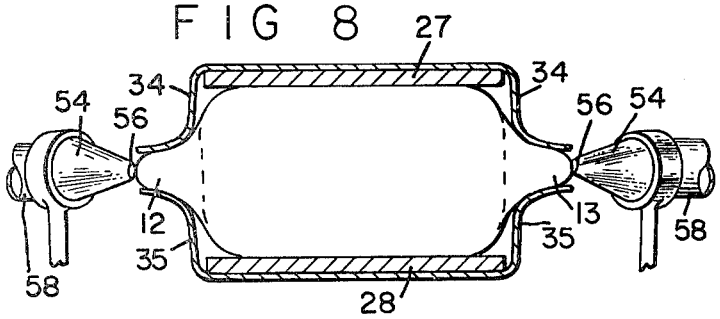

Referring first to FIGS. 5–11, the various steps of the present invention are graphically illustrated and will be briefly described without reference to the machinery involved in carrying out the steps. FIG. 5 shows an end view of a wrapped loaf of bread L, the bread being indicated at B of the wrapper at W. In FIG. 6 the loaf of bread is shown vertically compressed so that the displaced air within the wrapper creates bulges of excess wrapper material indicated at 12 and 13 at the sides of the loaf. In FIGS. 7 and 8 the bulges 12 and 13 are shown progressively compressed in the vertical direction to a mid point of the loaf. In FIG. 9 the bulges of excessive wrapper material 12 and 13 are clamped and pulled laterally and outwardly of the loaf, thereby pulling the wrapper taut for subsequent cutting of the bottom expanse of the wrapper to form two cut ends 14 and 15. FIGS. 10 and 11 show the final steps of separating the cut wrapper from the bread. The clamped portions 12 and 13 of the bread wrapper are pulled upwardly while the bread is retained, thereby separating the bread from the wrapper. The wrapper and bread are subsequently respectively conveyed to separate locations.

Figure 1:
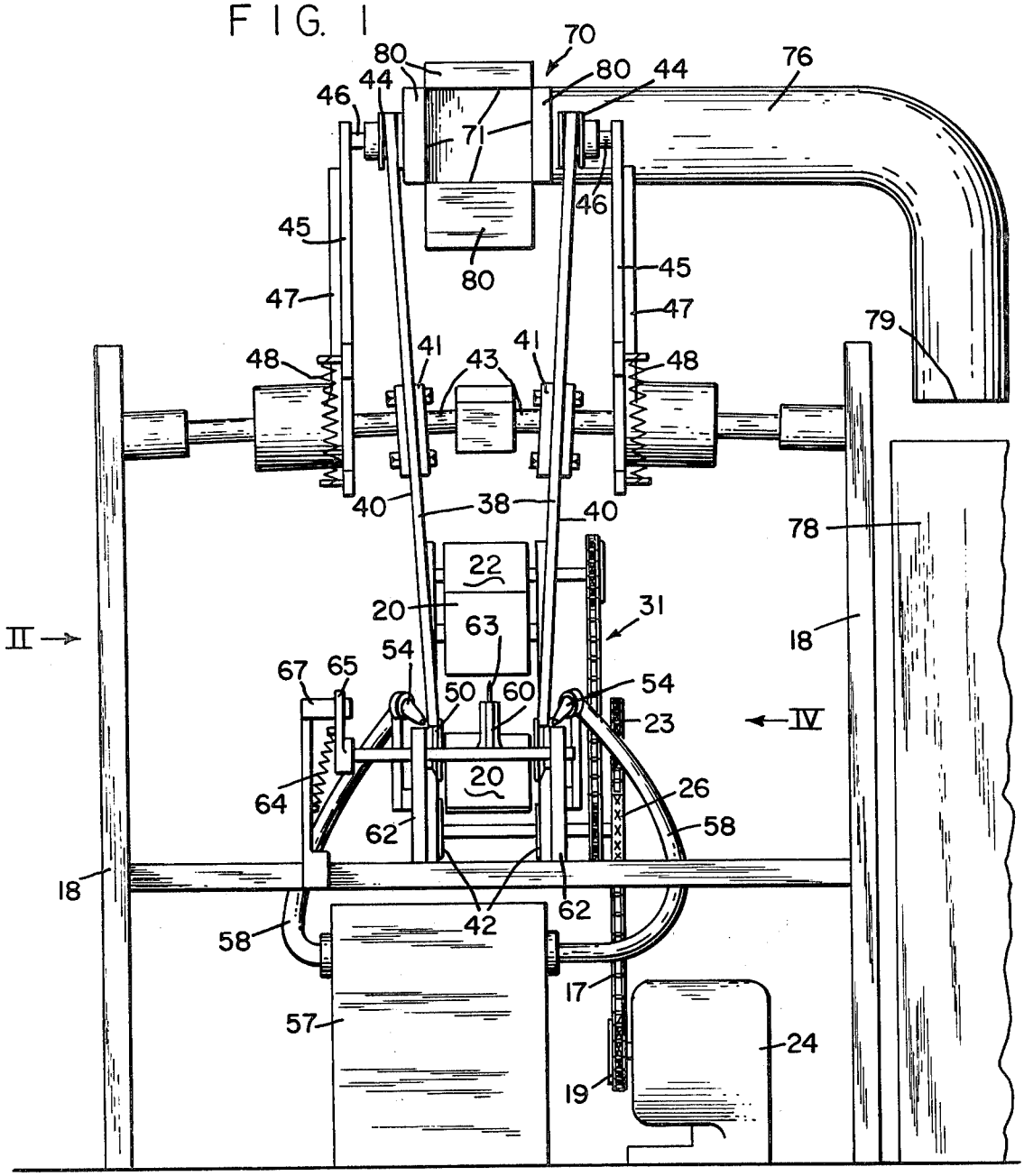
Figure 2:
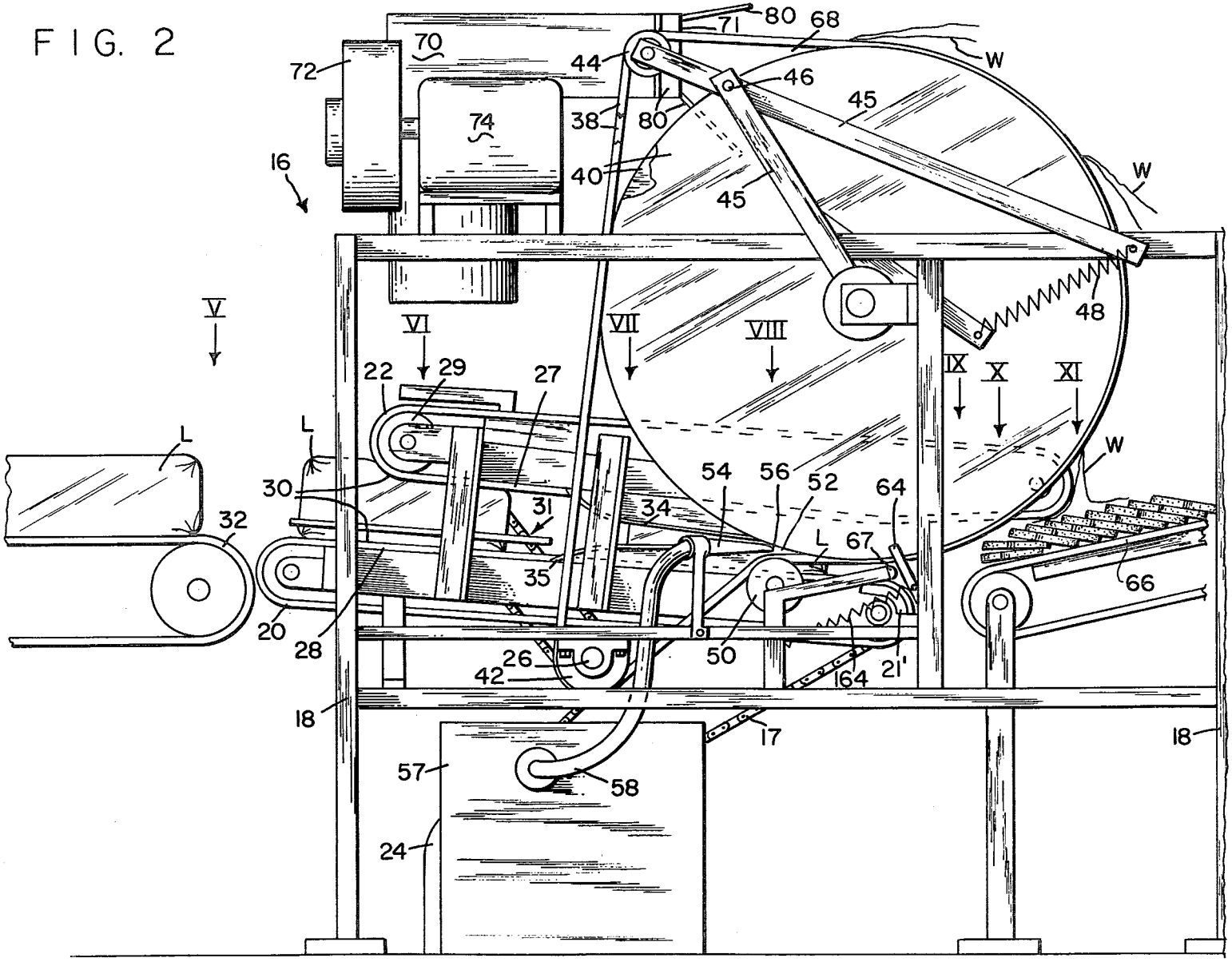
Figure 3:
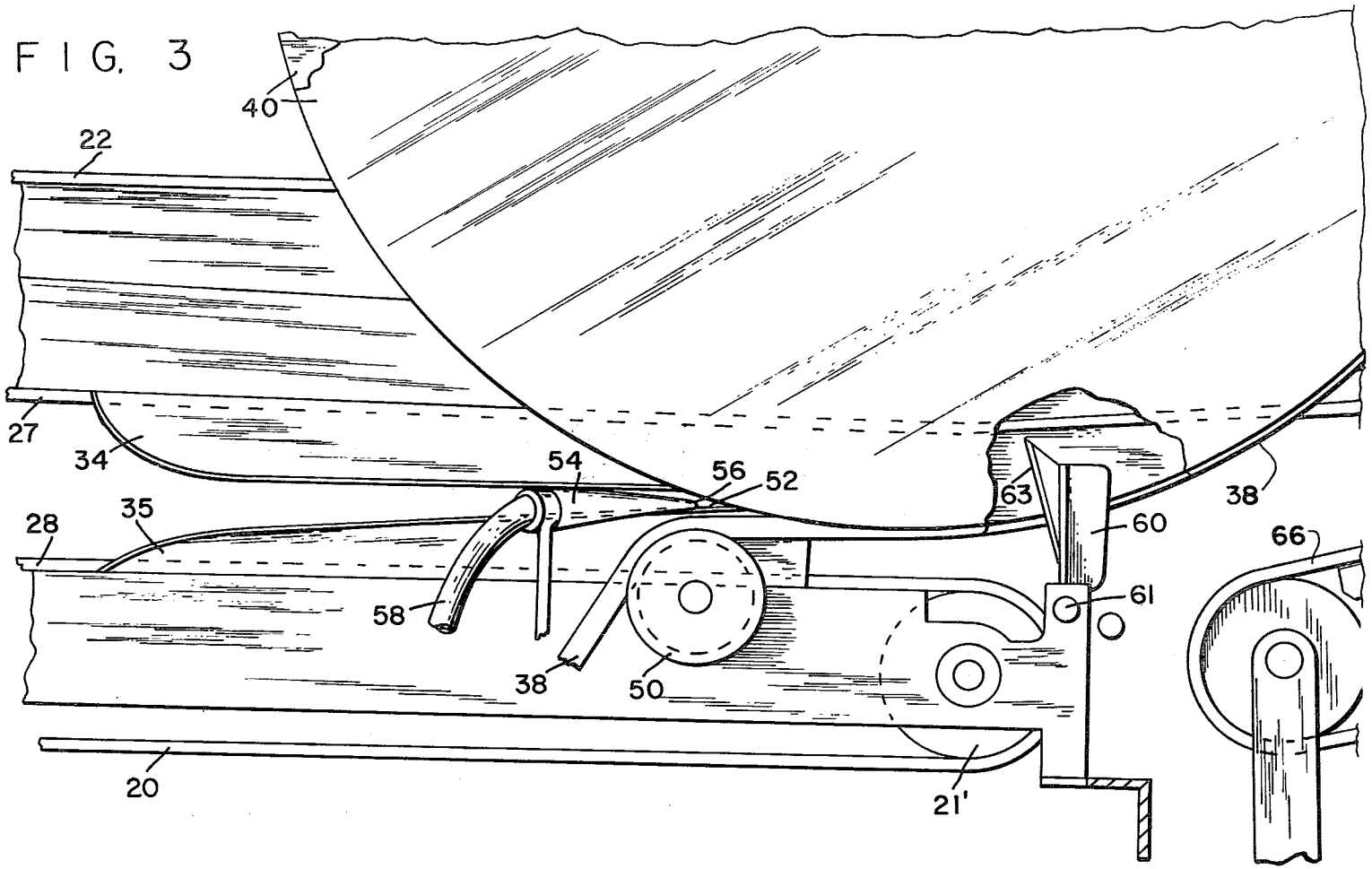
Figure 4:
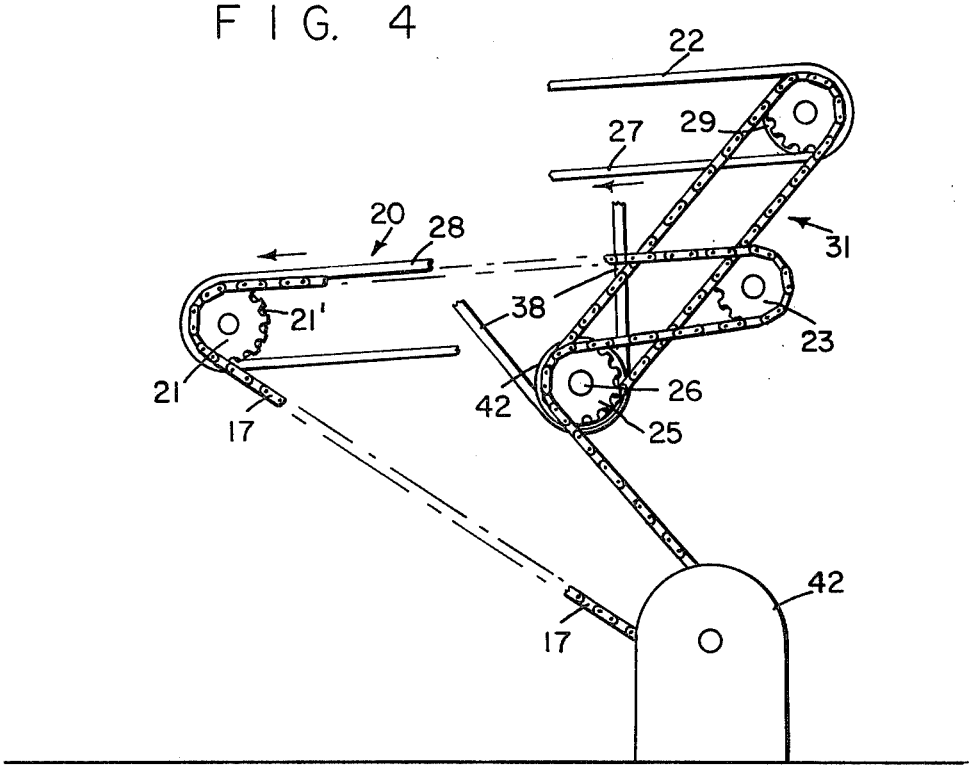

Referring to FIGS. 1–3, the machinery for carrying out the method of the present invention is generally indicated by the reference numeral 16 and includes a frame 18 which supports an endless bottom conveyor 20 and an enless upper conveyor 22. Conveyors 20 and 22 are driven by a motor 24 through appropriate chain and sprocket drive means, see particularly FIG. 4, so that the bottom run 27 of the top conveyor 22 and the top run 28 of the bottom conveyor 20 travel together from the rear of the machine to the front, from left to right as shown in FIG. 2. The chain and sprocket drive means for the conveyors as illustrated in FIG. 4, comprises a chain 17 driven by a sprocket 19 on the output shaft of motor 24. Chain 17 is trained around a sprocket 21 which drive a drive pulley 21' around which the lower conveyor 20 is trained. Chain 17 extends from sprocket 21 to an idler sprocket 23 and then around a sprocket 25 keyed to a jack shaft 26 and finally back to sprocket 19. The upper conveyor 22 is trained around a drive pulley 29 which is driven from jack shaft 26 through a separate chain and sprocket drive generally indicated by the reference numeral 31. Conveyors 20 and 22 form an entering nip 30 for receiving wrapped loaves of bread L from a supply conveyor 32 forming part of separate bread delivering machinery. The distance between the other run 27 of the top conveyor and the upper run 28 of the bottom conveyor is less than the normal vertical dimension of a wrapped loaf of bread, so that as the loaf enters the nip 30, it is vertically compressed, as shown in FIG. 2.

The compressed loaf of bread is advanced by conveyors 20 and 22 toward the front of the machine. The excess wrapper material 12 and 13 which results from compression of the loaf extends beyond the sides of ten conveyors, as shown in FIG. 6. As the compressed loaf is advanced toward the front of the machine, the excess material on each side of the loaf enters a guide means comprising the outwardly extending sides of a pair of upper and lower guide plates 34 and 35, respectively, which converge toward the front of the machine and cause the excess wrapper material 12 and 13 to be squeezed down to a central point of the loaf as shown in FIGS. 7 and 8.

Located forward of the spaced guide plates 34 are clamping means generally indicated by the reference numeral 36 comprising a pair of V-belts 38 trained around a pair of large idler pulleys 40 located on opposite side of the conveyors 20 and 22. Belts 38 are driven in counter-clockwise direction, as viewed in FIG. 2, by a pair of drive pulleys 42 keyed to jack shaft 26. Belts 38 are trained around upper guide pulleys 44. Each pulley 44 is mounted at one end of an arm 45, pivotally supported at 46 to a supporting bracket 47. The opposite end of each arm 45 is connected to a tension spring 48 which urges the upper idler pulley 44 away from its respective idler pulley 40 to maintain tension in the V-belt 38. Each belt 38 is also trained around a lower idler pulley 50 which guides the lower portion of the V-belt into engagement with the idler pulley 40, thereby forming an entering nip 52. At each side of the machine, plates 34 converge toward nip 52 for guiding the excess wrapper material at the side of the loaf into the entering nip where it is clamped, as shown in FIG. 9. Pulleys 40 are non-parallel and obliquely disposed from each other as shown in FIG. 1, so that they are at their closest point in the vicinity of the entering nip 52 and at their furthest point at an upper position diametrically opposed to the entering nip 52.

Idler pulleys 40 are mounted on bearings 41 rotatably mounted on a pair of oblique fixed shafts 45 supported within the framework 18, as shown in FIG. 1. At each side of the machine there is mounted a vacuum tube 54 which has a nozzle 56 adjacent the nip 52. Each nozzle 54 is connected to a source of sub-atmospheric pressure 57 through a hose 58. Vacuum tubes 54 draw the excess wrapper material 12 and 13 outwardly from the loaf to insure that the excess wrapper material is drawn into the entering nips 52. This function is particularly important in those occasional cases where the bread wrapper has lost its seal through a tear or puncture in the wrapper, so that the excess wrapper material does not bulge out from displaced air as shown in FIG. 6. In such cases, the excess wrapper material lies limp at each side of the loaf and is pulled out by the vacuum tubes.

The bottom conveyor 20 terminates at a point forward of the nips 52 below idler pulleys 40. A knife 60 is fixed to a shaft 61 pivotally mounted between supporting brackets 62 at the forward end of the bottom conveyor 20. Knife 60 has a blade 63 which extends above the upper run 28 of the bottom conveyor and is maintained in this position by a spring 64 acting through a lever 65 fixed to the shaft 61. Spring 64 draws lever 65 against a stop 67. Since the idler pulleys 40 are at their closest point in the vicinity of nips 52, the excess wrapper material 12 and 13 is pulled outwardly from the loaf, as shown in FIG. 9, as the loaf is advanced beyond nips 52. This action pulls the wrapper material taut along the bottom and top sections of the loaf as the bottom of the loaf passes over the blade 63, whereupon the bottom expanse of the wrapper is cut, as shown in FIG. 9.

A take-away conveyor 66 is located forward of the knife 60 and bottom conveyor 20. The top conveyor 22 extends forwardly of the bottom conveyor bridging the knife 60 and extending over a portion of the take-away conveyor 66. Each loaf of bread is transferred from bottom conveyor 20 to take-away conveyor 66 as it passes over the blade 63. The point of transfer occurs along the ascending portions of the idler pulleys 40. Since the excess wrapper portions 12 and 13 are still clamped between the pulleys 40 and V-belts 38, the bread wrapper W is pulled upwardly while the forward end of the top conveyor holds the bread down on the take-away conveyor 66, as shown in FIG. 10. Continued upward motion of the wrapper W causes the bread to be completely separated from the wrapper, as shown in FIG. 11. The bread without its wrapper is then advanced toward the right, as viewed in FIG. 2, but conveyor 66 toward bread processing machinery, not shown. The wrappers W which are still retained between the idler pulleys and belts 38 are brought to a point where the belts 38 separate from their respective pulleys 40, this point being indicated by the reference numeral 68. The wrappers W are drawn into a receptacle 70 by an air stream from point 68 to the opening 71 of the receptacle created by subatmospheric pressure in the receptacle 70. The subatmospheric pressure in receptacle 70 is created by a pump 72 driven by a motor 74. Pump 72 is also effective to create an air stream in a duct 76 which extends from the receptacle 70 and opens into a trash receptacle 78. Wrappers drawn into receptacle 70 are thereafter conveyed through duct 76 and deposited into trash receptacle 78 from the outlet opening 79 of the duct 76. Flanges 80 extending outwardly from opening 71 assist in guiding the wrappers W into the opening, as they are released from between the belts 18 and pulleys 40 at point 68.

During the operation of the machine 16, wrapped loaves of bread are fed to the machine 16 from a supply conveyor 32 on a continuous basis, so that several loaves of bread are in the machine at any one time at various stages in the unwrapping process. While one loaf of bread is being compressed in nip 30, another is approaching the nips 52, while another loaf is being cut along its bottom wrapper expanse, and still another is in its final stage of separation between the bread and the wrapper.

It is obvious that minor changes may be made in the form and construction of the invention without departing from the material spirit thereof. It is not, however, desired to confine the invention to the exact form herein shown and described, but it is hoped to include all such as properly come within the scope claimed.

The invention having been thus described, what is claimed as new and desired to secure by Letters Patent is:

1. Apparatus for removing the wrapper from a wrapped loaf of bread, the apparatus comprising:
   (a) means for conveying a wrapped loaf of bread,
   (b) means for vertically compressing the loaf of bread as it is being conveyed so that an excess of wrapper material is formed on each side of the loaf,
   (c) means for clamping the excess wrapper material on each side of the loaf while stretching the wrapper taut transversely during conveyance of the compressed loaf and for releasing the wrapper after removal of the bread therefrom,
   (d) a cutter for slitting the stretched wrapper at the bottom of the wrapped loaf while the loaf is conveyed, and
   (e) means for creating relative motion between the bread and cut wrapper to separate the wrapper from the bread.

2. Apparatus for removing a bread wrapper as recited in claim 1, wherein the means for conveying the wrapped loaf of bread comprises an endless bottom conveyor having an upper run and a lower run and driven so that the upper run travels toward the cutter and the means for compressing the wrapped loaf comprises an endless top conveyor having an upper run and a lower run and driven so that the lower run travels toward the cutter, the leading end of the top conveyor forming with the upper run of the bottom conveyor an entering nip for receiving the wrapped loaf bread, the distance between the lower run of the top conveyor being less than the vertical thickness of the wrapped loaf of bread.

3. Apparatus for removing a bread wrapper as recited in claim 2, wherein the lower run of the top conveyor converges toward the upper run of the bottom conveyor from the entering nip to the cutter.

4. Apparatus for removing a bread wrapper as recited in claim 1, wherein the means for clamping the excess wrapper material on each side of the loaf comprises a pair of endless retaining elements which are vertically separated in the area where the loaf is first compressed and converge at a point in advance of the cutter for clamping the excess wrapper material therebetween, the retaining elements advancing together with the loaf while moving laterally away from the loaf beyond the cutter for stretching the wrapper widthwise of the loaf, the retaining elements separating from each other and releasing the wrapper at a point beyond where the bread is pushed out of the wrapper.

5. Apparatus for removing a bread wrapper as recited in claim 4, wherein each retaining element comprises a V-belt and a V-belt pulley.

6. Apparatus for removing a bread wrapper as recited in claim 5, wherein the V-belts are positively driven and the V-belt pulleys are idler pulleys.

7. Apparatus for removing a bread wrapper as recited in claim 6, wherein one V-belt pulley is obliquely disposed with respect to the other V-belt pulley so that their respective outer peripheries are closest at a point in advance of the cutter and furthest apart at a point beyond the cutter and means for separating the cut wrapper from the bread.

8. Apparatus for removing a bread wrapper as recited in claim 4, comprising:
   (a) a receptacle having an opening at a point downstream of the point where the retaining elements separate, and
   (b) means for creating an airstream from the point of separation of the retaining elements and the receptacle opening for directing the empty bread wrapper into the opening.

9. Apparatus for removing a bread wrapper as recited in claim 8, wherein the airstream is produced by vacuum means drawing air into the receptacle through the opening.

10. Apparatus for removing a bread wrapper as recited in claim 1, wherein the cutting means comprises:
   (a) a blade mounted for movement from a position below the path along which the wrapped loaf of bread is conveyed to a position intersecting said path, and
   (b) means for biasing the blade in the intersecting position.

11. Apparatus for removing a bread wrapper as recited in claim 1, comprising means for guiding the excess wrapper material on each side of the loaf into the clamping means.

12. Apparatus for removing a bread wrapper as recited in claim 11, wherein the guiding means on each side of the loaf comprises a pair of spaced plates which converge toward the clamping means.

13. Apparatus for removing a bread wrapper as recited in claim 12, comprising means for creating air suction outside of the spaced plates for drawing the excess wrapper material outwardly between the spaced plates.

14. Apparatus for removing a bread wrapper as recited in claim 11, wherein the guiding means on each side of the loaf comprises a vacuum tube having an opening in front of and outside of the clamping means.

15. Apparatus for removing a bread wrapper as recited in claim 1 comprising means for conveying the bread separated from its wrapper to a disposition point.

* * * * *